US007597611B2

(12) United States Patent
Lamers

(10) Patent No.: US 7,597,611 B2
(45) Date of Patent: Oct. 6, 2009

(54) SANDPAPER LOADING SYSTEM AND APPARATUS

(76) Inventor: John Lamers, 333961 Plank Line, Ingersoll, ON (CA) N5C 3J8

( * ) Notice: Subject to any disclaimer, the term of this patent is extended or adjusted under 35 U.S.C. 154(b) by 0 days.

(21) Appl. No.: 12/017,376

(22) Filed: Jan. 22, 2008

(65) Prior Publication Data

US 2009/0186566 A1 Jul. 23, 2009

(51) Int. Cl.
*B24B 23/00* (2006.01)

(52) U.S. Cl. ..... 451/354; 451/520

(58) Field of Classification Search ..... 451/520, 451/354, 523, 524, 525, 344, 557
See application file for complete search history.

(56) References Cited

U.S. PATENT DOCUMENTS

| | | | | |
|---|---|---|---|---|
| 5,605,500 | A | 2/1997 | Matechuk | |
| 6,439,988 | B1 | 8/2002 | Long et al. | |
| 7,144,300 | B1 * | 12/2006 | Cybulski et al. | 451/28 |
| 7,264,541 | B1 | 9/2007 | Ray et al. | |
| 2004/0043715 | A1 | 3/2004 | Miles | |
| 2007/0155297 | A1 * | 7/2007 | Cybulski et al. | 451/523 |

* cited by examiner

*Primary Examiner*—Robert Rose

(57) ABSTRACT

A hand sander for attaching sandpaper thereto, the hand sander including a base having clamp ends; a handle for holding the sander in the hand; a clamping mechanism for clamping a sheet of sandpaper to each clamp end of the base wherein the clamping mechanism including a clamp pivoting between a clamp locked position and a clamp unlocked position and a planar generally upstanding tab resiliently biased against the clamp for locking the clamp in the clamp locked position. The tab including a shoulder for cooperatively engaging with a portion of the clamp thereby locking the clamp into the clamp locked position.

18 Claims, 7 Drawing Sheets

FIG 8
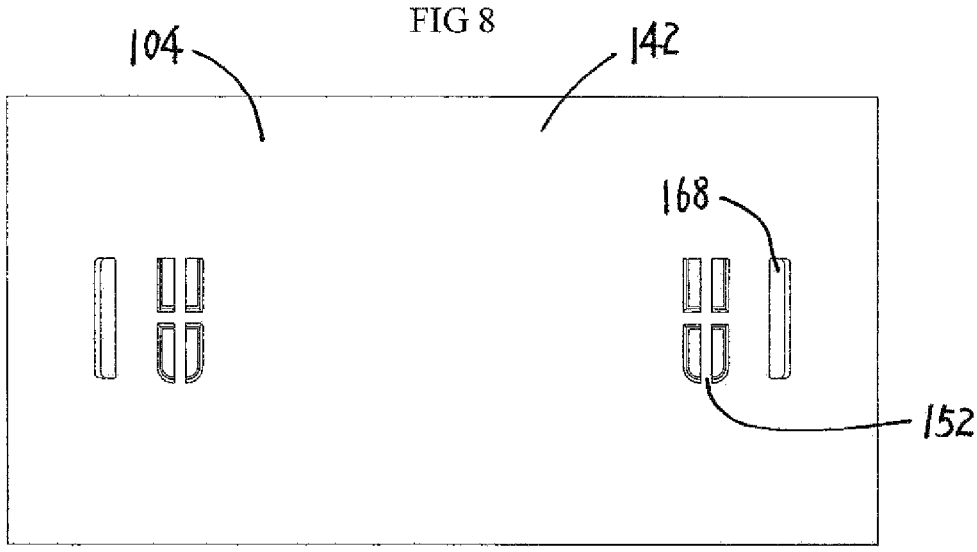
FIG 9
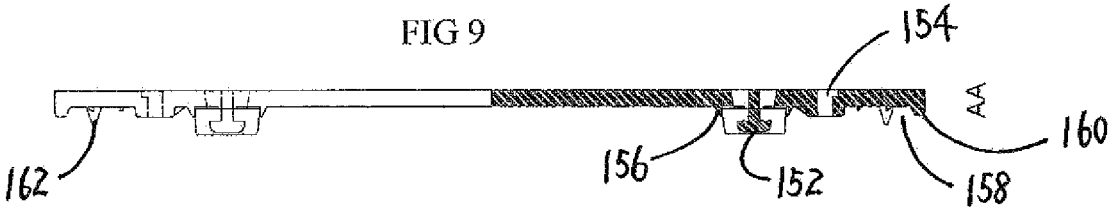
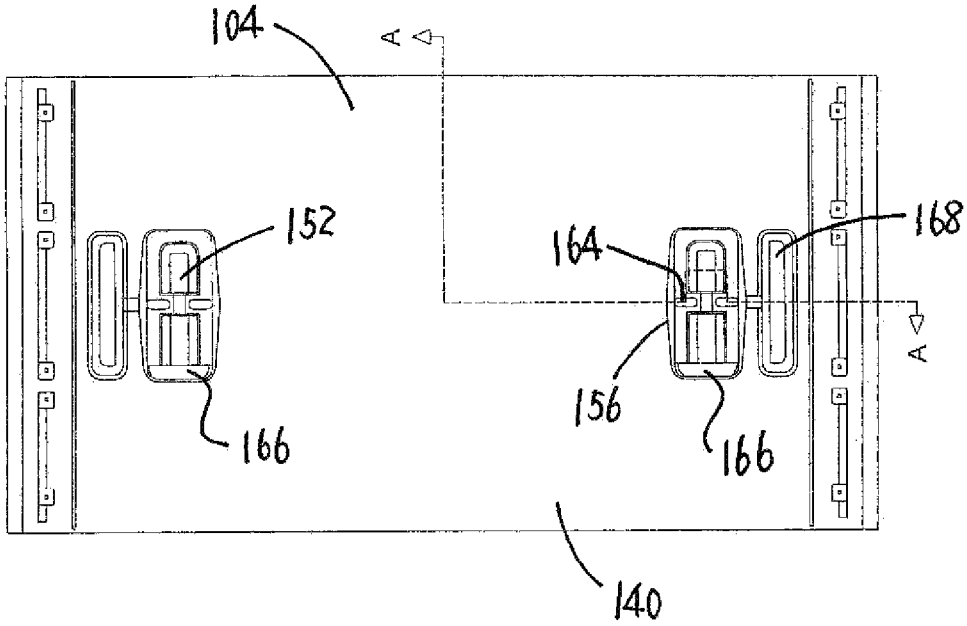
FIG 10

SANDPAPER LOADING SYSTEM AND APPARATUS

FIELD OF THE INVENTION

The present invention relates to hand sanding units and particularly relates to a system for loading sand paper and the construction of hand sanders.

BRIEF DESCRIPTION OF THE DRAWINGS

The invention will now be described by way of example only with reference to the following drawings in which:

FIG. 8 is a bottom elevational view of the base showing the base bottom.

FIG. 9 is a side elevational partial cross sectional schematic view taken partially along cross section lines A-A of FIG. 10.

FIG. 11 is a side elevational view of the right side of the handle.

DETAILED DESCRIPTION OF THE PREFERRED EMBODIMENT

Figure 1:
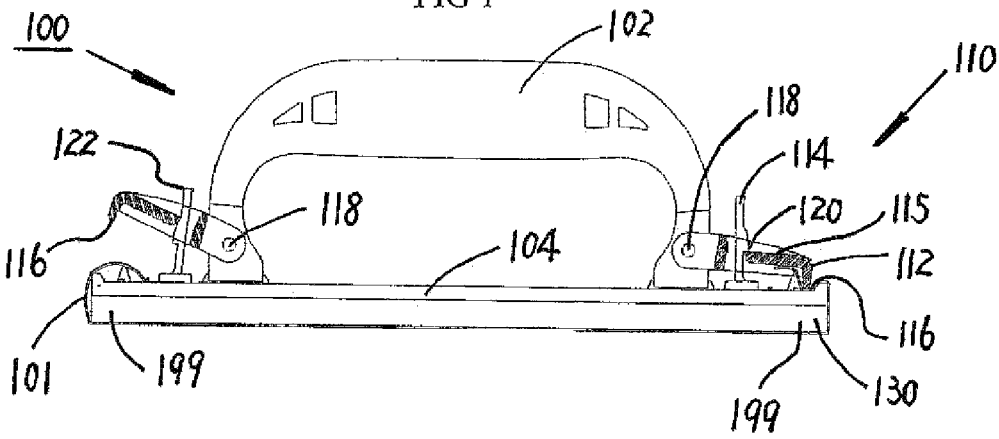
FIG. 1 is a schematic side elevational partial cross sectional view of a hand sander showing the clamping arrangement.
Figure 2:
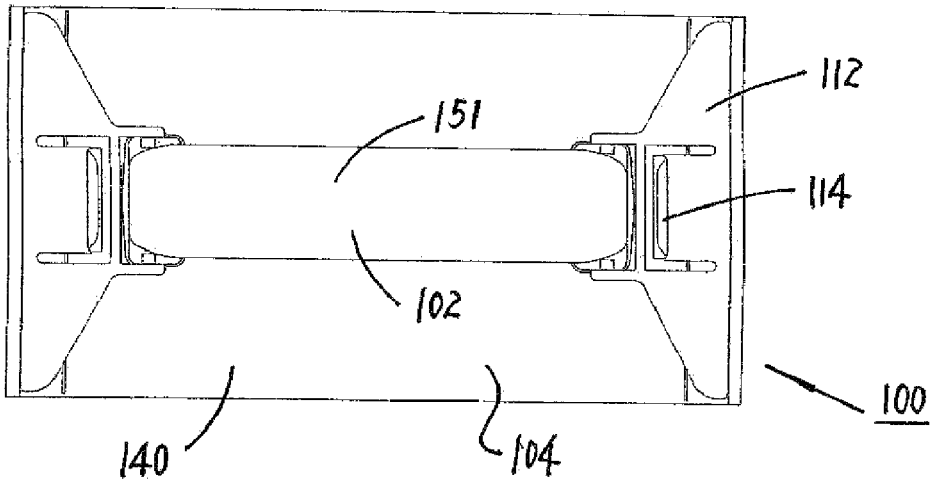
FIG. 2 is a schematic top elevational view of the hand sander shown in FIG. 1.
Figure 3:
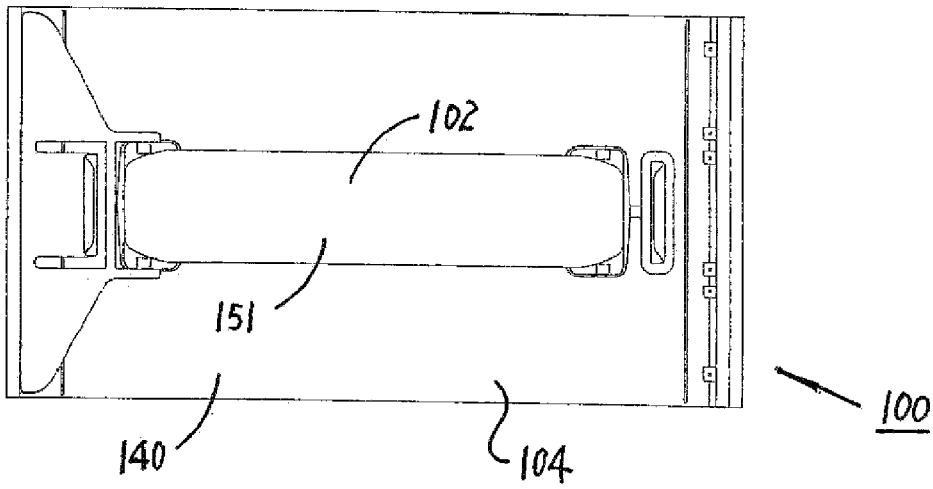
FIG. 3 is a schematic top elevational view of the hand sander shown in FIG. 1 with the right side clamped and tab removed.

The present device a hand sander shown generally as 100 includes the following major components, namely demountable handle 102, base 104, foam pad 130 and sand paper 101 attached thereto. The base having clamp ends 199 for clamping sandpaper 101 thereto. Handle 102 including handle ends 107 which attach to base 104. FIGS. 1, 2 and 3 show handle 102 in the mounted position 151.

On either side of base 104 is generally a clamping mechanism 110 which includes the following major components namely clamp 112 and tab 114. The tab being planar and generally upstanding relative to base 104. Tab 114 and clamp 112 having enough resiliency to resiliently bias one against the other.

Clamp 112 includes a tongue 115, a clamp edge 116, a reinforcing rib 190, a pivot shaft 192, a pivot arm 194 and a tab aperture 193.

Tab 114 preferably includes a finger pad 122, a shoulder 120 a tab base 182, a tab aperture 180. Tab 114 also includes a tab base 182 and the base 104 also includes a tab slot 154 such that the tab 114 is secured to the base 104 by urging tab base 182 into tab slot 168 such that tab base 182 is interferingly fits into tab slot 168.

Handle 102 includes pivot points 118 on both the left and right side of handle 102, T slots 170 for receiving T rail 152 therein, a front face 172 and a back stop 178 and protrusions 174 which register and couple with indents 164 found in base top 140 of base 104. Handle 102 is attached to base top 140 by sliding the handle T slots 170 onto the 'I' rails 152 located on base top 140 until front face 172 makes contact with rear stop 166 and back stop 178 contacts the front side of T rail 152. In the installed position as shown in FIGS. 1, 2 and 3 for example, protrusions 174 register with indents 164 and thereby secure handle 102 into position along T rails 152.

Figure 4:
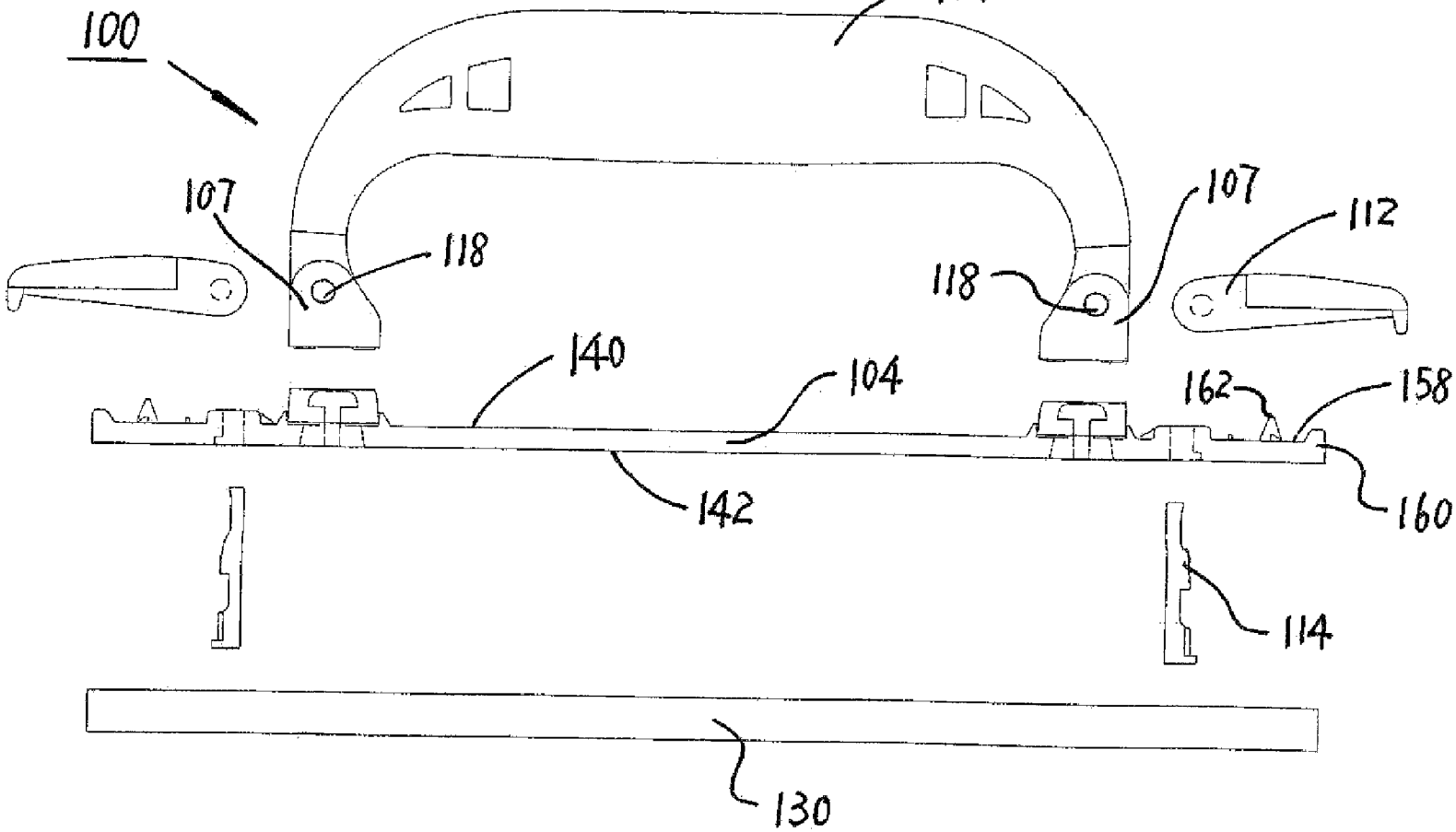
FIG. 4 is a schematic side elevational schematic exploded view showing schematically the components in exploded fashion of the hand sander.

Tabs 114 assembles onto base 104 by inserting tab 114 through base bottom 142 as shown in exploded view in FIG. 4. Tab 114 is urged through tab slot 158 until tab base 182 makes intimate contact with tab slot 168, thereby holding tab 114 in the installed position as shown in FIGS. 1, 5, 6 and 7 for example. Tab 114 is manufactured from resilient material and can be resiliently deformed and/or bent by applying finger pressure onto finger pad 122 thereby urging tab 114 into a tab rear position 148 as best shown in FIG. 6 thereby unlocking clamp 112.

A foam pad 130 is attached to base bottom 142 and thereafter sand paper 101 is installed overtop of foam pad 130. Each distal end of sand paper 101 is wrapped around base 104 and is locked by clamp 112, such that clamp edge 116 makes intimate contact with sand paper 101 forcing it into transversely oriented U channel 158 which is formed in between ridge 160 and spikes 162 which are defined on base top 140 near each clamp end 199 of base 104. As best shown in FIGS. 1, 5, 6 and 7 clamp 112 is placed into a clamp unlocked position 150 by urging tab 114 into the tab rearward position 148 as shown for example on either end in FIG. 6 of sander 100. In this manner with tab 114 in tab rearward position 148, clamp 112 can be pivoted upwardly about pivot point 118 as shown into clamp unlocked position 150 in FIG. 5 and also in FIG. 7.

With clamp 112 in clamped unlocked position 150, one is able to insert the distal ends of sand paper 100 underneath clamp edge 116 thereby placing sandpaper 101 into the correct position. Thereafter, clamp 112 is urged downwardly into the clamp locked position 144, by deflecting tab 114 into the tab rearward position 148 on the way down. Clamp 112 continues to be urged downwardly until such time as the tongue 115 of clamp 112 is urged underneath and makes intimate contact with shoulder 120 of tab 114. In the clamp locked position, clamp edge 116 forceably clamps the end of sand paper 101 against the base top 140 within U channel 158. Furthermore, spikes 162 also grab and hold onto sand paper 101 and ridge 160 forceably causes sand paper 101 to be deformed downwardly onto base top 140. In this manner it is not possible or very difficult to pull sand paper 101 out of or away from clamp 112 thereby holding sand paper 101 rigidly into position. Clamp 112 is attached to pivot point 118 by inserting pivot shaft 192 of clamp 112 into pivot apertures 176 of handles 102. Thereby clamps 112 will pivot about pivot point 118 which is located on handle 102.

The reader with note that tab 114 is normally found in the tab forward position 146 and must be forceably resiliently urged backwardly by applying pressure to finger pad 122 in order to put tab into the tab rearward position 148. Clamp 112 is free to pivot about pivot point 118 and has the tendency to be in either the clamp locked position 144 or the clamp unlocked position 150 unless held therein position by tab 114. Urging clamp 112 downwardly over tab 114 also deflects tab 114 into the tab rear ward position by sliding down along inclined surface 121 of tab 114. Finger pressure is applied to finger pad 122 of tab 114 resiliently deflects away tab 114 from clamp 112 and places tab into rearward position 148 thereby releasing clamp 112 from the clamp locked position 144 once the clamp 112 has cleared the tab shoulder 120.

Figure 5:
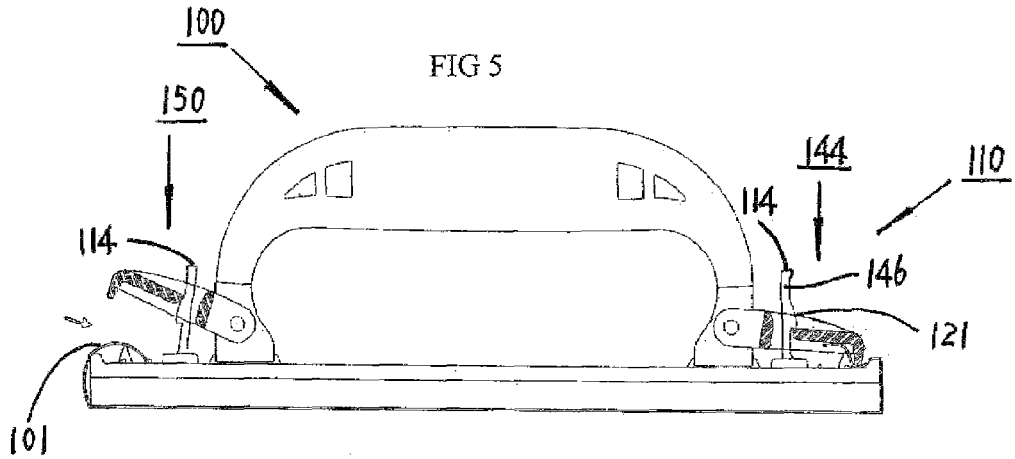
FIG. 5 is a schematic side elevational partial cross sectional schematic view of the hand sander showing the clamping mechanism in a clamped lock position on the right side and in a clamp unlocked position on the left side.
Figure 6:
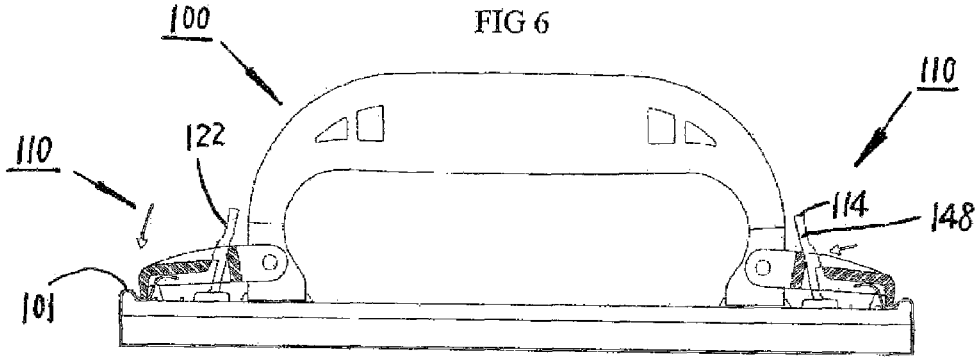
FIG. 6 is a side elevational partial cross-sectional schematic view of the hand sander showing the tab in a tab rearward position for unlocking or locking of the clamps.
Figure 7:
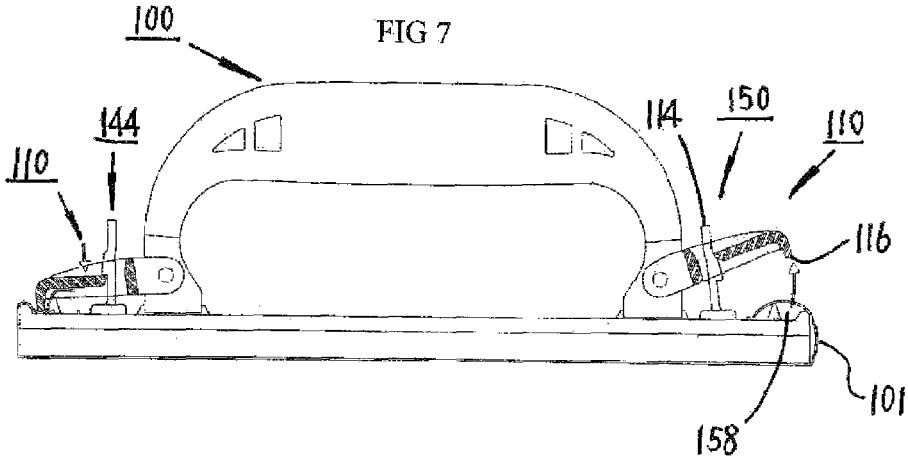
FIG. 7 is a side elevational partial cross sectional schematic view of the hand sander showing the clamping mechanism in a clamped unlocked position on the night side and a clamped locked position on the left side.
Figure 11:
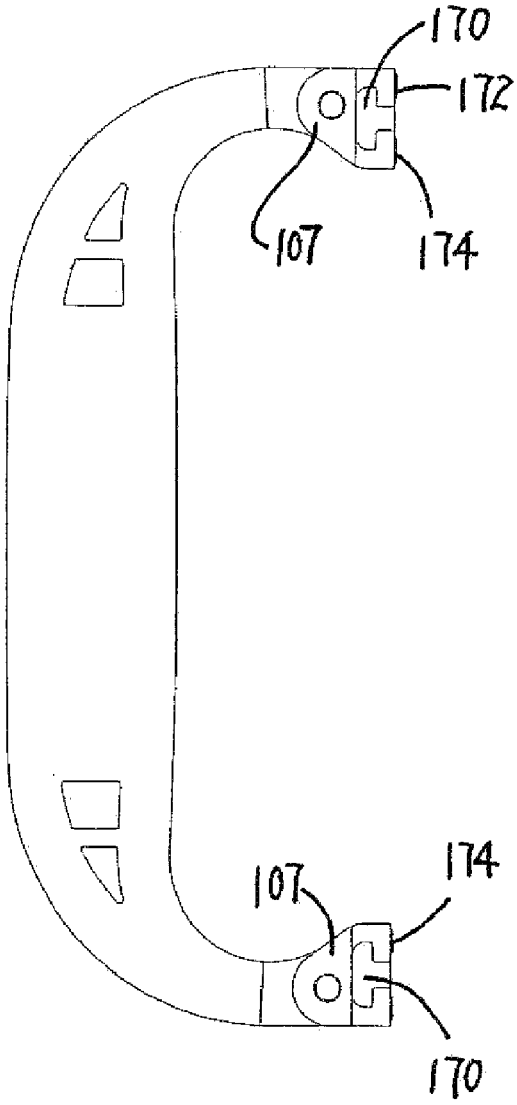
FIG. 11 is a top elevational schematic view of the base top.
Figure 12:
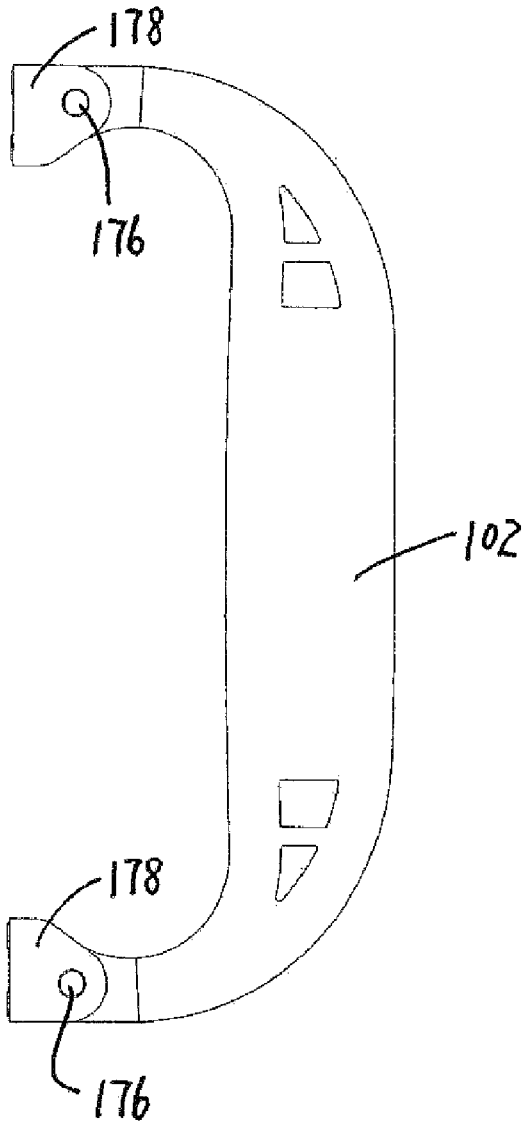
FIG. 12 is a side elevational view of the left side of the handle.
Figure 13:
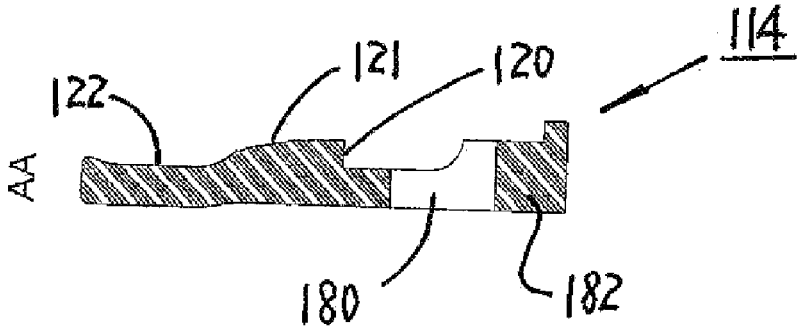
FIG. 13 is a cross sectional view taken along lines A-A of FIG. 14 of the tab.
Figure 14:
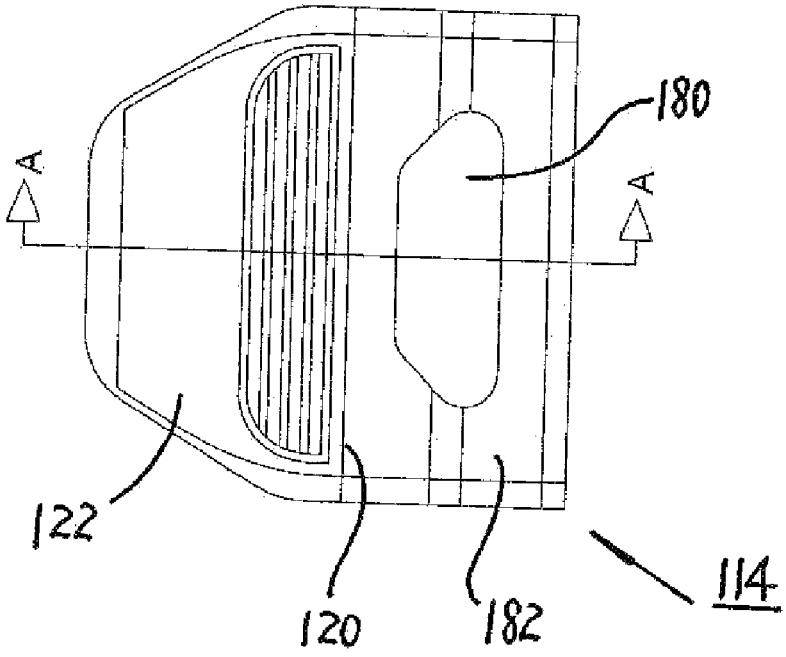
FIG. 14 is a top elevational view of the tab.
Figure 15:
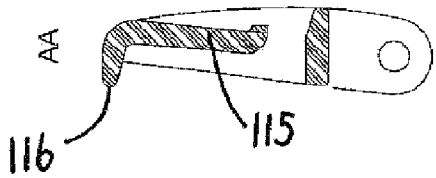
FIG. 15 is a side partial cross sectional view of the clamp taken along lines A-A of FIG. 16.
Figure 16:
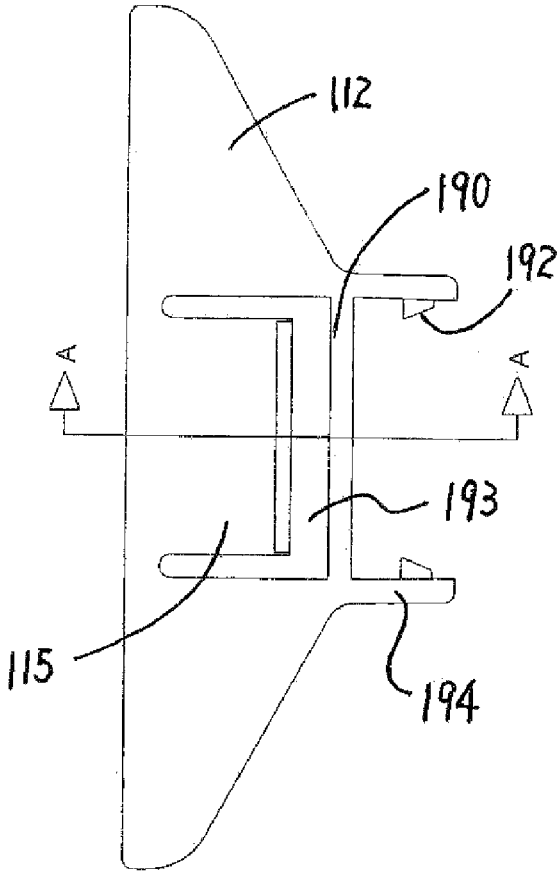
FIG. 16 is a top plan view of the clamp.
Figure 17:
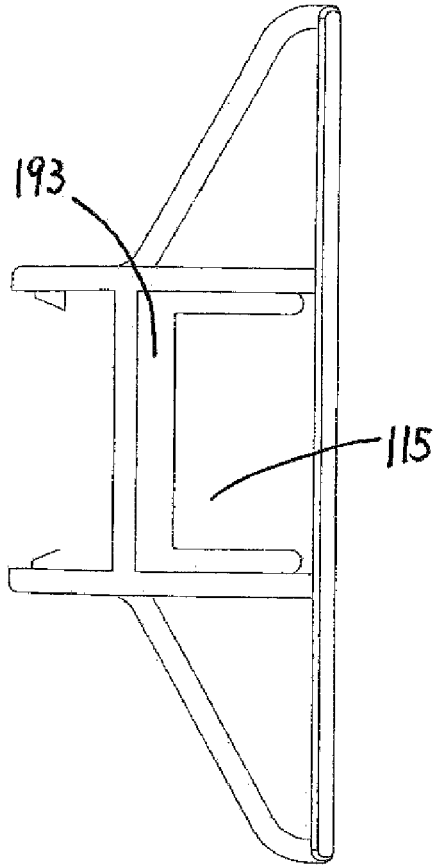
FIG. 17 is a bottom plan view of the clamp.

Shoulder 120 found on tab 114 makes intimate contact with the distal end of tongue 115 found on clamp 112, thereby forceably retaining clamp 112 in the clamp locked position 144 as best shown on the right hand side of FIG. 5 or the left hand side of FIG. 5 or the left hand side of FIG. 7. In the clamp locked position 144 the clamp tongue 115 is oriented substantially transversely to the tab 114 such that the tab 114 is resiliently biased horizontally against the tongue 115 and the tongue 115 is resiliently biased vertically against the shoulder 120 of the tab 114.

It should be apparent to persons skilled in the arts that various modifications and adaptation of this structure described above are possible without departure from the spirit of the invention the scope of which defined in the appended claim.

I claim:

1. A hand sander for attaching sandpaper thereto, the hand sander comprising:

a) a base having clamp ends;

b) a means for holding the sander in the hand;

c) a clamping mechanism for clamping a sheet of sandpaper to each clamp end of the base;

d) wherein the clamping mechanism including a clamp pivoting between a clamp locked position and a clamp unlocked position;

e) a planar generally upstanding tab resiliently biased against the clamp for locking the clamp in the clamp locked position, f) wherein the clamp further includes a clamp edge and the base includes a transversely oriented U shaped channel proximate the base ends such that the clamp edge is adapted to urge a portion of the sheet of sandpaper into the U channel thereby fixing the sandpaper to the base.

2. The hand sander claimed in claim 1 wherein the tab including a shoulder for cooperatively engaging with a portion of the clamp thereby locking the clamp into the clamp locked position.

3. The hand sander claimed in claim 1 wherein the tab including a finger pad such that when finger pressure is applied to the finger pad the tab is resiliently deflected away from the clamp into a tab rearward position thereby releasing the clamp from the clamp locked position once the clamp has cleared the tab shoulder.

4. The hand sander claimed in claim 1 wherein the tab including a tab base, and the base including a tab slot such that the tab is secured to the base by urging tab base into tab slot such that tab base interferingly fits into tab slot.

5. The hand sander claimed in claim 1 wherein the clamp including a tongue for resiliently biasing against a tab shoulder of the tab thereby locking the clamp into the clamp locked position.

6. The hand sander claimed in claim 1 wherein in the clamp locked position the clamp tongue oriented substantially transversely to the tab such that the tab biased horizontally against the tongue and the tongue biased vertically against the shoulder of the tab.

7. The hand sander claimed in claim 5 wherein the tab including a finger pad such that when finger pressure is applied to the finger pad the tab is resiliently deflected away from the tongue into a tab rearward position thereby releasing the clamp and allowing it to pivot into the clamp unlocked position once the tongue is above and has cleared the tab shoulder.

8. The hand sander claimed in claim 5 wherein the tab including an inclined surface such that pivoting the clamp from the clamp unlocked position downwardly the tongue makes contact with the tab inclined surface thereby resiliently deflecting the tab into a tab rearward position until the tongue engages with tab shoulder which allows the tab to return to the tab forward position.

9. The hand sander claimed in claim 1 wherein the U channel is defined by a transversely oriented ridge running along one side of the U channel and a series of pointed spikes running along the other side of the U channel thereby minimising any unwanted movement of the sandpaper.

10. The hand sander claimed in claim 1 wherein the holding means including a demountable handle.

11. The hand sander claimed in claim 10 wherein the handle including T shaped slots which cooperatively intermesh with T shaped rails defined on a base top of the base such that the T slots interferingly slide engagingly onto the T rails thereby demountably attaching the handle to the base in a mounted position.

12. The hand sander claimed in claim 11 wherein the handle ends further including small protrusions which cooperatively register with small indents defined in the base top when the handle is mounted onto the base thereby preventing unintentional demounting of the handle from the base.

13. The hand sander claimed in claim 12 wherein the handle ends further include a back stop which makes contact with the T rail preventing further engaging movement of the handle along the Trails.

14. The hand sander claimed in claim 13 wherein the base further includes rear stops for making contact with a front face of the handle ends thereby preventing further engaging movement of the handle along the Trails.

15. A hand sander for attaching sandpaper thereto, the hand sander comprising:

a) a base having clamp ends;

b) a demountable handle for holding the sander in the hand;

c) a clamping mechanism for clamping a sheet of sandpaper to each clamp end of the base;

d) wherein the clamping mechanism including a clamp pivoting between a clamp locked position and a clamp unlocked position, e) wherein the handle including T shaped slots which cooperatively intermesh with T shaped rails defined on a base top of the base such that the T slots interferingly slide engagingly onto the T rails thereby demountably attaching the handle to the base in a mounted position.

16. The hand sander claimed in claim 15 wherein the handle ends further including small protrusions which cooperatively register with small indents defined in the base top when the handle is mounted onto the base thereby preventing unintentional demounting of the handle from the base.

17. The hand sander claimed in claim 16 further including a planar generally upstanding tab resiliently biased against the clamp for locking the clamp in the clamp locked position.

18. The hand sander claimed in claim 17 wherein the tab including a finger pad such that when finger pressure is applied to the finger pad the tab is resiliently deflected away from the clamp into a tab rearward position thereby releasing the clamp from the clamp locked position once the clamp has cleared the tab shoulder.

* * * * *